US007073262B2

(12) United States Patent
Melton

(10) Patent No.: US 7,073,262 B2
(45) Date of Patent: Jul. 11, 2006

(54) EYEBROW COMB ATTACHMENT FOR HAIR CLIPPER

(75) Inventor: Scott A. Melton, Erie, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 10/459,291

(22) Filed: Jun. 11, 2003

(65) Prior Publication Data

US 2004/0250428 A1 Dec. 16, 2004

(51) Int. Cl.
*B26B 19/00* (2006.01)
*B26B 19/38* (2006.01)

(52) U.S. Cl. ..... 30/233.5; 30/200

(58) Field of Classification Search ..... 30/200, 30/195, 233.5, 179, 233, 30, 182, 173, 196–201; 7/136

See application file for complete search history.

(56) References Cited

U.S. PATENT DOCUMENTS 356,434 A * 1/1887 Washburn ..... 30/202
1,957,430 A 5/1934 Adelmo
4,614,036 A * 9/1986 Haraguchi ..... 30/200
4,776,095 A * 10/1988 Tsujimoto et al. ..... 30/201
5,050,305 A * 9/1991 Baker et al. ..... 30/201
5,054,199 A * 10/1991 Ogawa et al. ..... 30/34.1
5,105,541 A * 4/1992 Messinger et al. ..... 30/34.1
6,618,948 B1 * 9/2003 Lin ..... 30/233.5

FOREIGN PATENT DOCUMENTS

EP 0 928 670 A1 7/1999
GB 2 245 211 A 1/1992

* cited by examiner

*Primary Examiner*—Kenneth E. Peterson
*Assistant Examiner*—Phong Nguyen
(74) *Attorney, Agent, or Firm*—Greer, Burns & Crain, Ltd.

(57) ABSTRACT

An eyebrow comb attachment for attachment to a hair clipper having a bladeset with a moving blade laterally reciprocating relative to a stationary blade, includes a guard formation for blocking access to ends of the bladeset and defining a cutting area between the ends, and at least one deflecting formation associated with the guard formation for deflecting hair clippings generated by action of the bladeset in the cutting area. The attachment preferably includes at least one guide formation associated with the cutting area and configured for guiding hair into the cutting area for clipping.

18 Claims, 5 Drawing Sheets

EYEBROW COMB ATTACHMENT FOR HAIR CLIPPER

BACKGROUND OF THE INVENTION

The present invention relates generally to hair clipping devices used for trimming facial hair, whether manually operated or powered. Specifically, the present invention relates to such trimming devices intended for use in trimming eyebrows.

It is not uncommon to use a powered hair trimmer or hair clipper for trimming the hair of one's eyebrows. However, one drawback to the use of a power trimmer around the eyes is that the clippings generated in the trimming process can become caught in the eye and be irritating to the user. Another drawback of using powered trimmers for eyebrow trimming is that the trimmer itself must be located in relatively close proximity to the eye. As a result, the user must take special care to avoid the trimmer blades from becoming close to or contacting with the eye or eyebrow. This latter concern is especially applicable to individuals whose brow ridges do not extend far beyond the outer margin of the eye. In other words, for individuals with relatively deep-set eyes, the issue of the clipper blades coming in close contact with the eye is less of an issue.

While it is known to use conventional trimmers or clippers having attachment combs for trimming eyebrow hair, one disadvantage of that application is that the relatively wide cutting blade of such devices risks cutting any hair of the normal head hair which happens to be on the forehead or in close proximity to the eyebrow area. Another drawback of using conventional hair trimmers with combs for eyebrow trimming is that the relatively wider blade inherently entails comb teeth which typically extend the full width of the blade, which may come in close proximity to the eye.

Still another concern for individuals using electric or powered trimmers for trimming eyebrow hair is that in some cases, the trimming edge of the blade is obscured either by the clipper itself, or the individual's hand. If possible, visibility of the cutting area through at least one and preferably both eyes is preferable in accurately achieving well-trimmed eyebrows.

Thus, there is a need for a device for trimming eyebrow hair which facilitates the use of a hair trimmer and which helps prevent hair clippings from entering the eye. In addition, there is a need for a device for use with a powered hair trimmer design for eyebrow trimming in which the clipper or trimmer blades are prevented from coming in contact with the user's eye.

BRIEF SUMMARY OF THE INVENTION

The above-identified needs are addressed by the present eyebrow comb attachment for a hair clipper, which is removably attachable to a conventional hair trimmer or hair clipper blade end. The attachment of the present device is similar to that of a conventional attachment comb. One feature of the present attachment is a blade guard for obscuring, masking or blocking much of the width of the cutting edge of the conventional clipper blade, and revealing only a relatively small cutting area of the blades for access to the eyebrow area. In this manner, the user's eyes are protected from the moving clipper blades. Another feature of the present eyebrow attachment is that deflecting surfaces are provided for helping prevent hair clippings from entering the eye. Still another feature of the present eyebrow comb attachment is the provision of comb teeth for guiding eyebrow hair into the relatively narrow, unobscured or exposed cutting area where the blades are available for cutting.

More specifically, the present invention provides an eyebrow comb attachment for attachment to a hair clipper having a bladeset with a moving blade laterally reciprocating relative to a stationary blade, includes a guard formation for blocking access to end portions of the bladeset and defining a cutting area between the end portions, and at least one deflecting formation associated with the guard formation for deflecting hair clippings generated by action of the bladeset in the cutting area. The attachment preferably includes at least one guide formation associated with the cutting area and configured for guiding hair into the cutting area for clipping.

DETAILED DESCRIPTION OF THE INVENTION

Figure 1:
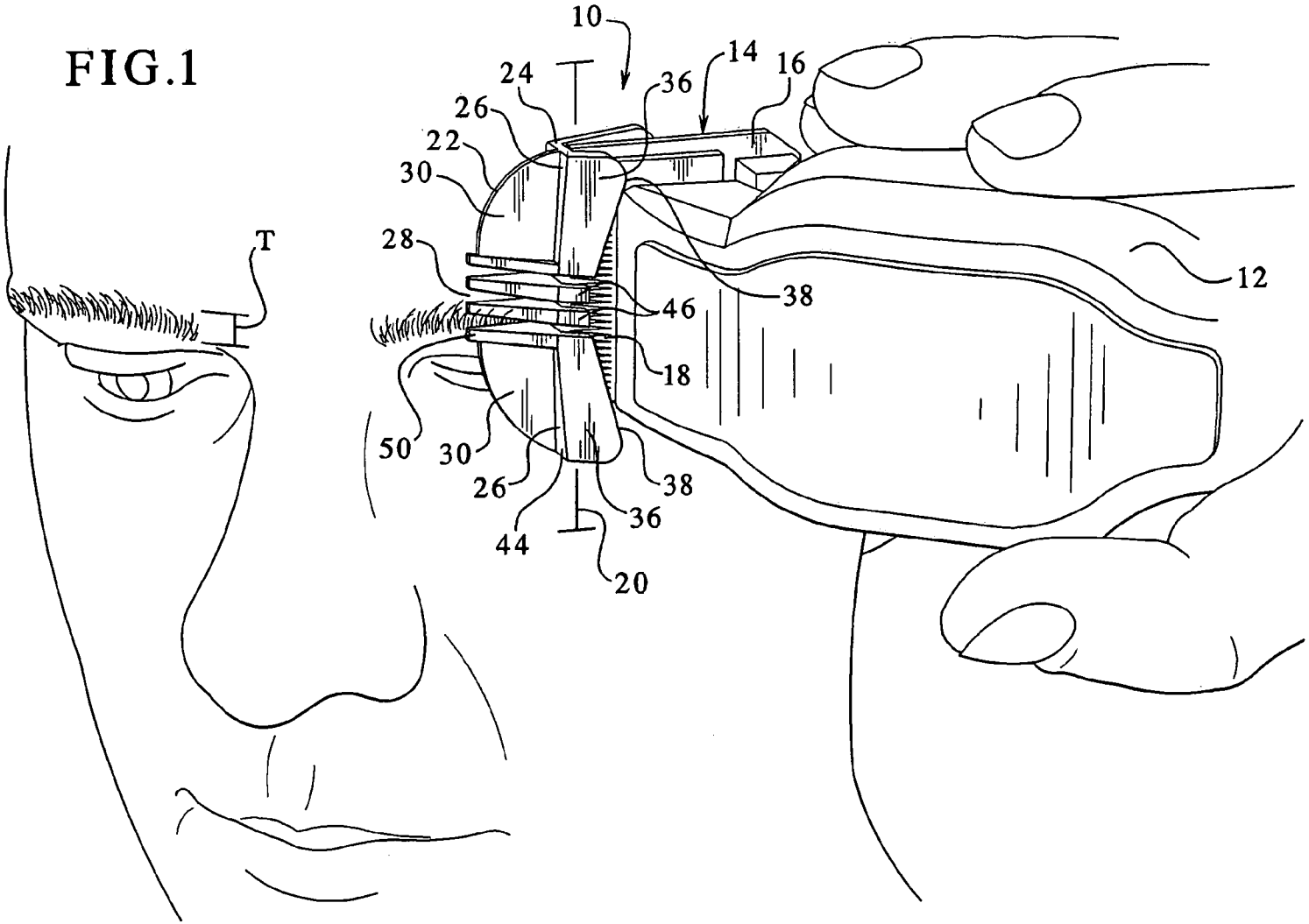
FIG. 1 is an elevational view of a powered hair clipper fitted with the present eyebrow comb attachment and being used on a users' eyebrow.

Referring now to FIG. 1, a powered hair clipper or hair trimmer (here used interchangeably) suitable for use with the present attachment is generally designated 10. Included on the clipper 10 is a housing 12 enclosing a power source (not shown) preferably an electric motor, powered by line voltage or batteries as is well known in the art. While a powered hair clipper 10 is depicted, it is contemplated that the present attachment is usable on manually operated clippers as are known in the art. One end of the housing 12 is the mounting point for a bladeset 14 formed by a stationary blade 16 and a moving blade 18 (best seen in FIG. 5). Cutting is performed by lateral reciprocal movement of the moving blade 18 relative to the stationary blade 16, which results in a scissors action. Both of the blades 16, 18 have a plurality of teeth, and the reciprocal movement of the blades causes cutting action along a cutting line 20 extending the width of the blades. As is known in the art, such clippers 10 are widely used for personal grooming such as hair cutting, beard and mustache trimming and eyebrow trimming.

For facilitating eyebrow trimming, and for addressing some of the above-identified needs, the present eyebrow comb attachment 22 is releasably attachable to the bladeset 14, preferably to the stationary blade 16. The attachment 22 is specifically designed to help prevent cut hair from falling into the user's eyes, for protecting the user's eyes from contact with the bladeset 14 and for guiding eyebrow hair into the bladeset for cutting. Further, the profile of the attachment 22 is designed to minimize the obstruction to the user's field of view when using the product, at the same time providing adequate blocking and deflecting of hair clippings. In the preferred embodiment, the attachment 22 is integrally molded from a suitably durable plastic material, however other materials are contemplated as are known in the art.

Referring now to FIGS. 1–5, included on the attachment 22 is a guard formation 24 configured for blocking or masking the operation of the bladeset 14 for a significant portion of the bladeset width. It is desirable for the bladeset 14 to cut hair only the approximate height or thickness ("T") of an eyebrow to minimize the possibility of stray head hair being inadvertently cut, and for protecting the user's eyes from unwanted contact with the bladeset 14. Thus, in the preferred embodiment, the guard formation 24 is configured to overlie a significant portion of cutting edges of the bladeset 14, preferably in two spaced apart end portions 26 which block access to corresponding ends of the bladeset.

An exposed area referred to as the cutting area 28, located between the opposing end portions 26, provides access by the bladeset 14 to the eyebrow hair. For purposes of example only, in a preferred embodiment, a standard 1.6 inch wide bladeset is obscured by the guard formation 24 so that only a central 0.4 inch is exposed in the cutting area 28. In other words, approximately ⅔ to ¾ of the cutting area of the bladeset 14 is blocked. It is contemplated that other dimensions for the cutting area may be desirable depending on the application or the width of the clipper or trimmer blades.

Another feature of the attachment 22 is at least one deflecting formation associated with the guard formation 24 for deflecting hair clippings generated by action of the bladeset in said cutting area. In the preferred embodiment, there are two such deflecting formations, a first is referred to as a fan rib 30 which projects from the line 20 in a first direction from the guard formation 24, or forward of the guard formation as the clipper 10 is viewed in FIG. 1. The fan rib 30 is provided adjacent at least one side of the cutting area 28, and preferably in two portions separated by the cutting area 28. In addition, the fan rib 30 is dimensioned to provide deflecting of hair clippings away from the user's eyes, while at the same time providing adequate visibility of the cutting area, as the user observes the cutting action in a mirror. Accordingly, the fan rib 30 is provided with a curved and radiused forward edge 32, and a generally straight rear edge 34 along the attachment line to the guard formation 24. When viewed from above, the fan rib defines a general "D"-shape (best seen in FIG. 2). The forward edge 32, as well as all other exposed edges of the attachment 22, are preferably radiused or rounded for facilitating movement along the skin and/or in the hair of the user.

Figure 2:
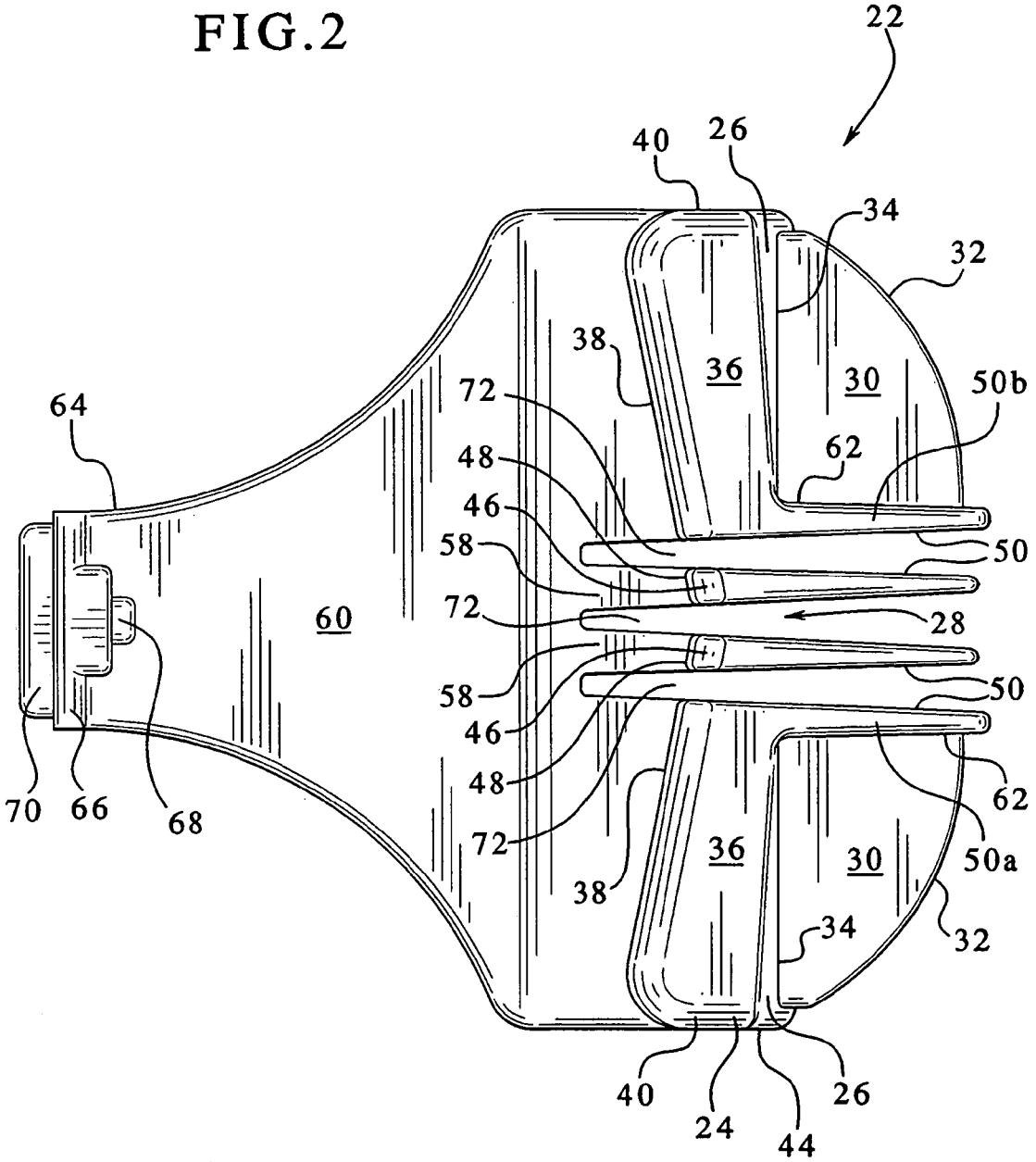
FIG. 2 is an overhead plan view of the attachment shown in FIG. 1.

A second deflecting formation is at least one deflecting surface 36 in closely spaced relationship to the moving blade 18. In the preferred embodiment, the at least one deflecting surface 36 includes a pair of said surfaces disposed on either side of the cutting area 28, the surfaces 36 having a profile configured for providing additional deflecting surface with increased distance from the cutting area. In other words, as seen in FIGS. 1 and 2, each deflecting surface 36 has a rearward-facing edge 38 when viewed relative to the clipper 10 which is tapered from side ends 40 of the attachment 22 toward the cutting area 28. Thus, additional deflecting area is progressively provided by the deflecting surfaces 36 towards the ends 40. As seen in the FIGS., the fan rib 30 is a deflecting formation projecting from the cutting line 20 in a first direction, and the at least one deflecting surface 36 is at least one second formation projecting from the line in a second direction distinct from the first direction.

Figure 5:
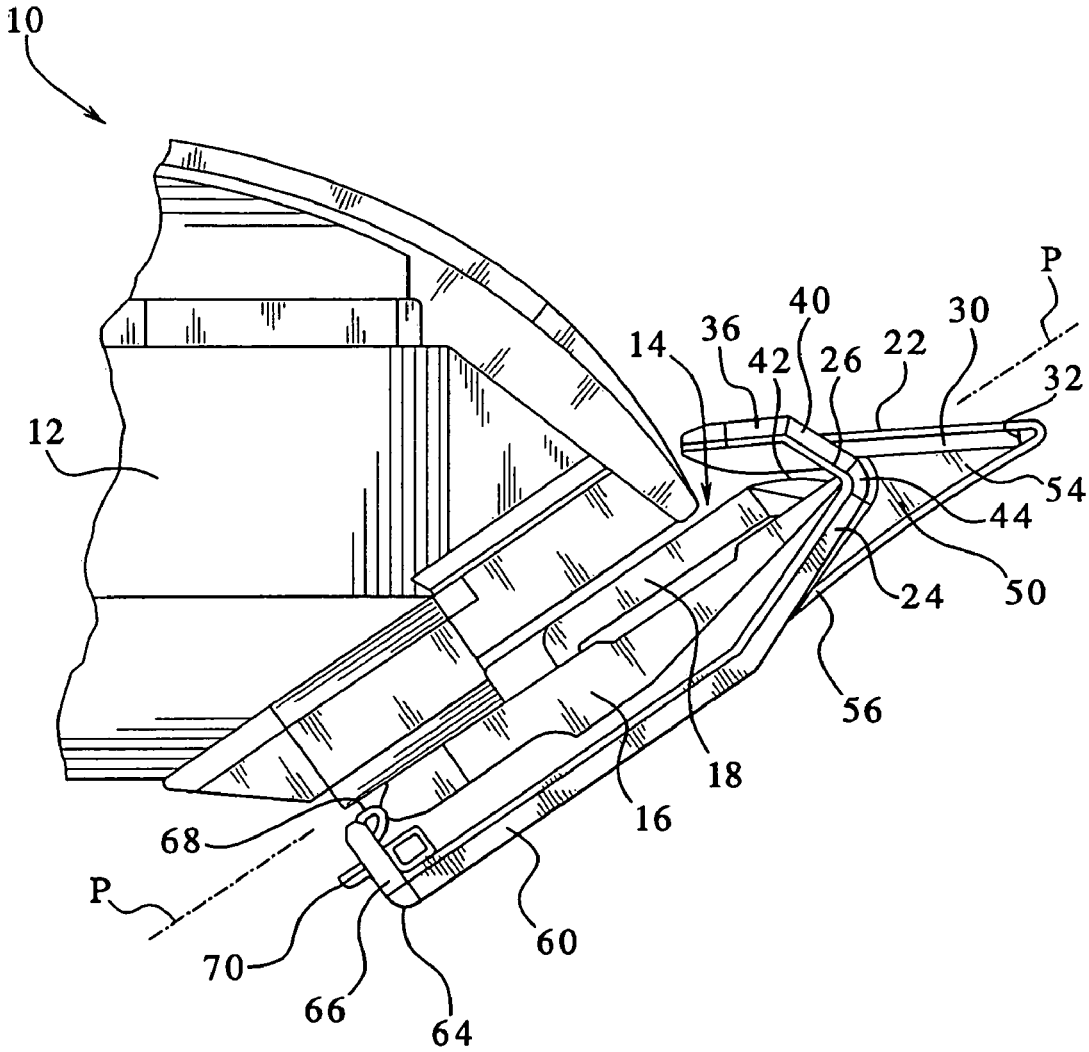
FIG. 5 is a side view of the present attachment shown mounted on a clipper.

Referring now to FIG. 5, another feature of the at least one deflecting surface 36 is that a spaced relationship is defined relative to an upper end 42 of the moving blade 18. The deflecting surfaces 36 are secured to, and preferably integrally formed with, the guard formation 24. More specifically, the guard formation 24 includes a leading edge 44 which forms a generally forward projecting wedge or "V"-shape corresponding to a profile when viewed from the side defined by the bladeset 14. The deflecting surfaces 36 are panel-like and are joined to the leading edge 44 and preferably project at an inclined angle relative to an angle defined by the leading edge. It is contemplated that the degree of inclination of the deflecting surfaces 36 relative to the leading edge 44 may vary to suit the application, depending on, among other things, the profile of the bladeset 14, the speed of the clipper 10, and the desired amount of deflection, depending on the application.

In a further preferred embodiment, it is noted that the fan rib 30 is also inclined relative to the plane "P" of blade reciprocation (FIG. 5). While the degree of inclination may vary to suit the application, it is preferred that the degree of inclination of the fan rib 30 to the plane P and to the bladeset 14 will be the same as the degree of inclination of the deflecting surfaces 36.

Referring now to FIGS. 1 and 2, additional deflecting is provided between the deflecting surfaces 36 by at least one spaced deflector pad 46 disposed in the cutting area 28. The pads 46 are spaced relative to each other and between the deflecting surfaces for facilitating the flow of clippings therethrough. If the cutting area 28 were to be totally blocked, during trimming clippings would become clogged between the deflecting surface and the moving blade 18.

Figure 3:
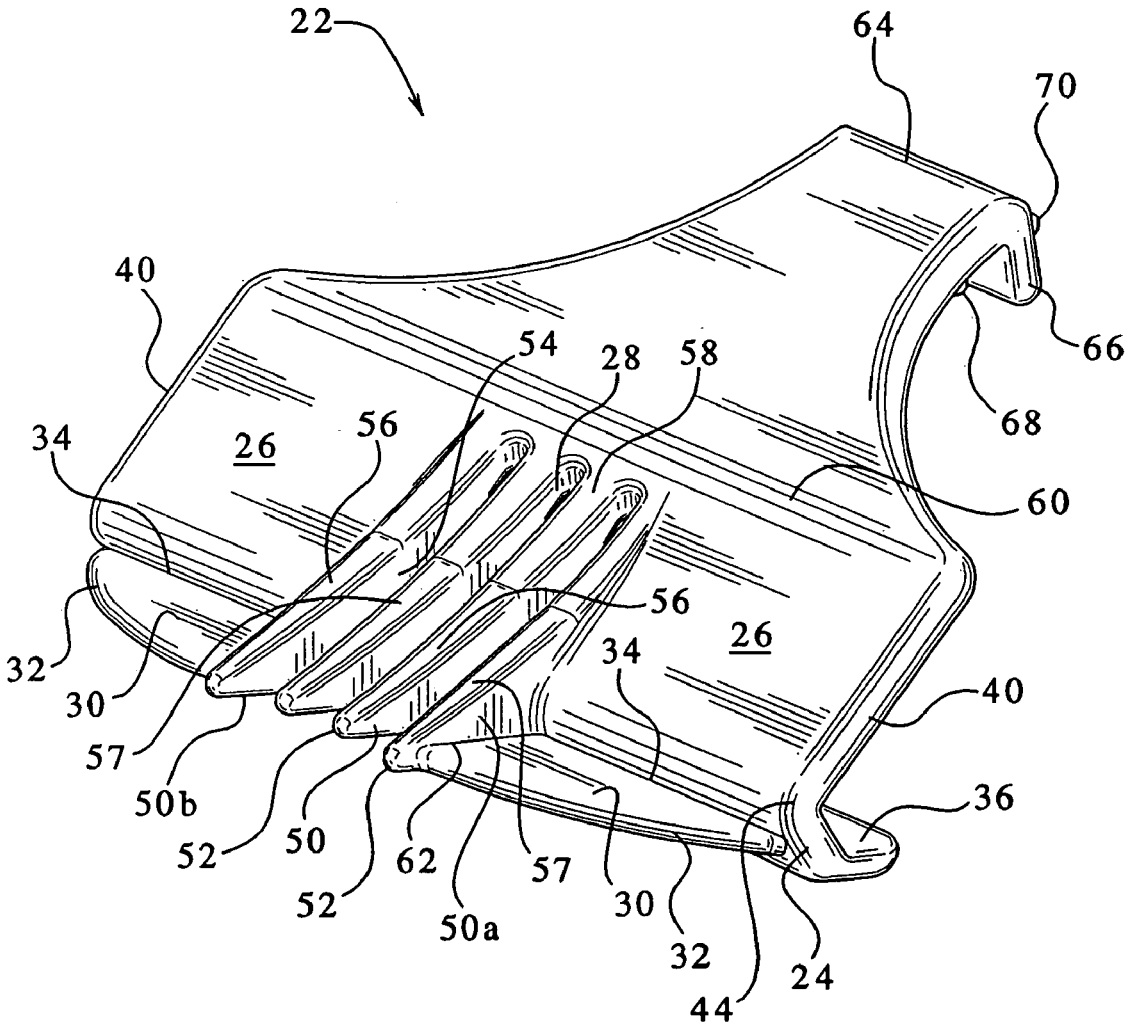
FIG. 3 is a bottom perspective view of the attachment shown in FIG. 2.
Figure 4:
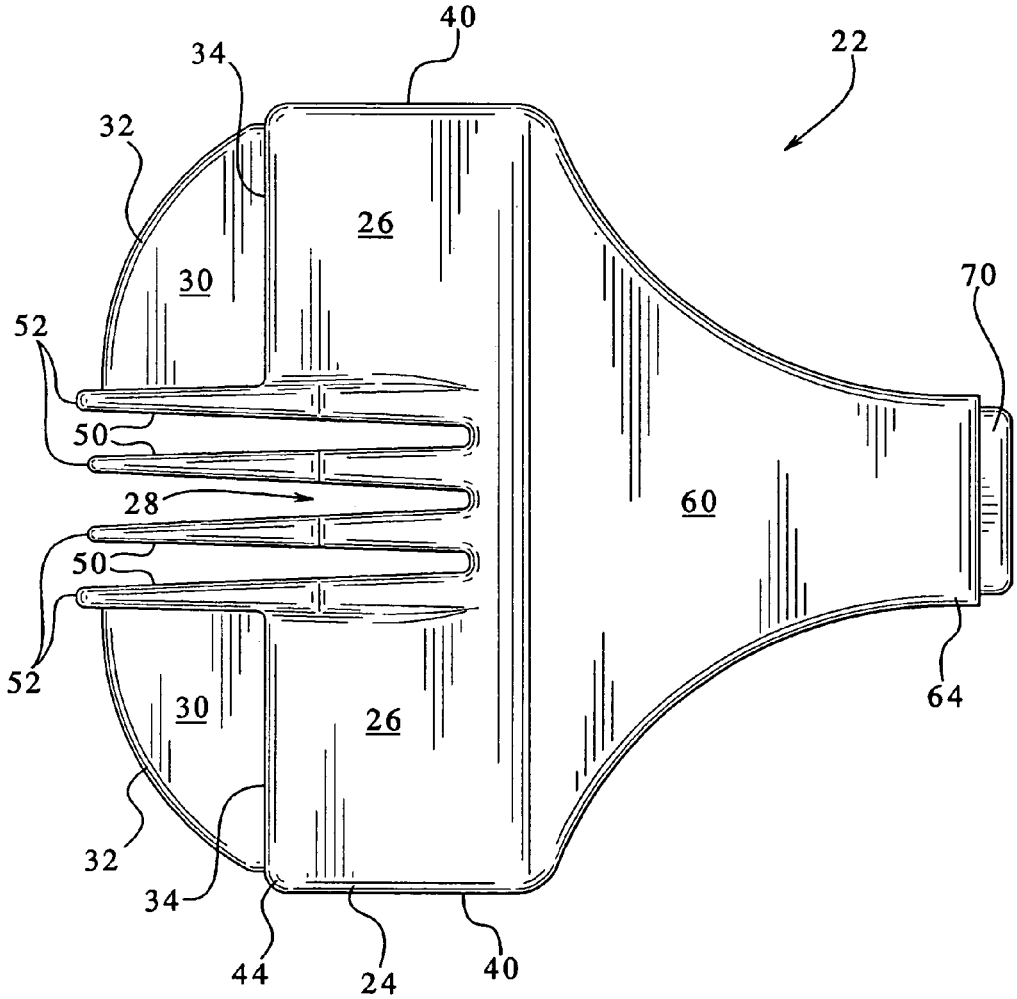
FIG. 4 is a bottom plan view of the attachment of FIG. 3.

In the preferred embodiment, the deflector pads 46 are located at ends 48 of each of at least one guide formation 50 associated with the cutting area 28 and configured for guiding hair into the cutting area for clipping. Preferably, as is known in the attachment comb art, the at least one guide formation 50 is a plurality of spaced comb teeth having generally pointed (but radiused and thus blunted) tips 52 (best seen in FIG. 3). Each tooth 50 has a generally solid tooth wall 54 (FIG. 3) with a radiused border edge 56, and is secured at its root 58 (FIG. 2) to a base 60 of the guard formation 24. As seen in FIG. 3, lower edges 57 of the comb teeth 50 are curved as is known in the art to follow the surface of the brow ridge on the user's head.

Referring now to FIGS. 2 and 3, it will be seen that the outermost teeth 50*a* and 50*b* are attachment points for corresponding edges 62 of the fan ribs 30. Thus, in the preferred embodiment, the fan ribs 30 extend from the leading edge 44 of the guard formation 24 to the corresponding outermost teeth 50*a*, 50*b*. It has been found that this configuration provides adequate deflecting area while not overly obscuring the cutting area 28 from view by the user during the eyebrow trimming operation. It is also contemplated that the particular shape and orientation of the fan ribs 30 may vary to suit the application.

Referring now to FIGS. 2 and 5, the attachment 22 is configured for releasable attachment to the bladeset 14, and specifically to the stationary blade 16 as is known in the art. More particularly, the base 60 of the guard formation 24 extends to a rear end 64 of the attachment 22. While the profile of the base 60 may vary, to save material in production, it is preferred that the base gradually tapers from a point generally adjacent the edge 38 of the deflecting surfaces 36 toward the rear end 64. At the rear end 64, a connection formation preferably taking the form of a generally normally-extending latch wall 66 including a latch lug 68 for engaging the stationary blade 16. Further, it is preferred that at least one gripping formation 70 for facilitating the removal of the attachment 22 from the clipper 10.

In operation, and referring now to FIG. 1, upon attachment to the clipper 10, the present attachment 22 substantially blocks the teeth of the bladeset due to the wedge shaped leading edge 44 of the guard formation 24. Only at the cutting area 28 are the blades 16, 18 exposed and available for trimming. This enclosure of the blades 16, 18, protects the user's eyes from the blades themselves and also from clippings generated during the trimming process. The cutting area 28 is dimensioned to be about as wide as the eyebrow. As the clipper 10 is moved along the eyebrow, the guide teeth 50 guide hair into the cutting area 28 for trimming by the blades 16, 18. Clippings are deflected by combined action of the fan rib 30, the deflecting surfaces 36, as well as the deflector pads 46. Another operational characteristic of the present attachment 22, particularly when used in the orientation of FIG. 1, is that clippings pass through spaces 72 (FIG. 2) between adjacent deflector pads 46 and between the pads 46 and the deflecting surfaces 36. By exiting through those spaces 72, the clippings are more easily prevented from reaching the eye area.

Another feature of the present eyebrow comb attachment 22 is that it performs the functions of guarding the eye, deflecting clippings and guiding eyebrow hair into a relatively narrow cutting area while minimizing the overall profile of the unit. Thus, visibility of the cutting area by the user is kept reasonably open.

Thus, it will be seen that the present attachment 22 facilitates the use of a standard clipper 10 for trimming eyebrows. Clippings are deflected away from the eyes and radiused edges protect the eyes from the attachment surfaces as well as the bladeset 14. In addition, the overall shape of the attachment is configured for providing sufficient deflection and protection, while also providing visibility of the eyebrow area by the user.

While a particular embodiment of the present eyebrow comb attachment for hair clipper has been described herein, it will be appreciated by those skilled in the art that changes and modifications may be made thereto without departing from the invention in its broader aspects and as set forth in the following claims.

The invention claimed is:

1. An eyebrow comb attachment in combination with to a hair clipper having a bladeset with a moving blade laterally reciprocating relative to a stationary blade, comprising:

a guard formation having two continuous, spaced portions configured for blocking access of hair to a pair of continuous, spaced, blocked portions of the bladeset, for preventing hair cutting by the blocked portions and defining a relatively narrow cutting area between the continuous, spaced, blocked portions;

at least one deflecting formation associated with said guard formation for deflecting hair clippings generated by action of the bladeset in said cutting area, said at least one deflecting formation including at least one planar fan rib projecting generally forward from, and adjacent at least one side of said cutting area, each said at least one fan rib projecting forwardly from said guard formation in a plane parallel to a cutting line defined by the bladeset and generally inclined relative to a plane of reciprocation defined by the bladeset on either side of said cutting area for deflecting clippings away from a subject's eyes; and at least one guide formation associated with said cutting area and configured for guiding hair into said cutting area for clipping;

said at least one fan rib curves in an arc from a side of a corresponding one of said at least one guide formation to one of said spaced portions blocking access of hair to the bladeset.

2. The attachment and hair clipper of claim 1 wherein said at least one guide formation is a plurality of spaced comb teeth.

3. The attachment and hair clipper of claim 1 wherein said at least one deflecting formation includes at least one deflecting surface in closely spaced relationship to the moving blade of said clipper.

4. The attachment and hair clipper of claim 3 wherein said at least one deflecting surface includes a pair of said surfaces disposed on either side of said cutting area, said surfaces having a profile configured for providing additional deflecting surface with increased distance from said cutting area.

5. The attachment and hair clipper of claim 4 further including at least one spaced deflector pad disposed in said cutting area between said deflecting surfaces.

6. The attachment and hair clipper of claim 1 wherein said at least one deflecting formation includes at least one deflecting surface in spaced relationship to the moving blade of said clipper.

7. The attachment of and hair clipper claim 1 wherein the bladeset defines a cutting line, and said at least one deflecting formation includes at least one first formation projecting from the line in a first direction, and at least one second formation projecting from the line in a second direction distinct from said first direction.

8. The attachment and hair clipper of claim 7 wherein said at least one first formation is said at least one fan rib, and said at least one second formation is at least one deflecting surface.

9. The attachment and hair clipper of claim 7 wherein said at least one second formation is at least one deflecting surface which is inclined relative to the bladeset.

10. The attachment and hair clipper of claim 9 wherein the said at least one fan rib and said at least one deflecting surface are inclined at approximately the same angle relative to the bladeset.

11. The attachment and hair clipper of claim 10 further including at least one gripping formation for facilitating the removal of said attachment from the clipper.

12. The attachment and hair clipper of claim 1 further including a plurality of comb teeth projecting from said cutting area, and said at least one deflector formation including a pair of said fan ribs, each rib of said pair extending between an outer edge of said guard formation and a corresponding next adjacent one of said plurality of comb teeth.

13. The attachment and hair clipper of claim 1 further including a connection formation for releasably connecting said at least one guard formation to the stationary blade.

14. The attachment and hair clipper of claim 1 wherein the bladeset has a width, and said at least one guard formation blocks approximately ⅔ to ¾ of the width of the bladeset.

15. An eyebrow comb attachment in combination with to a hair clipper having a bladeset with a moving blade laterally reciprocating relative to a stationary blade, comprising:

a guard formation configured for blocking access by hair to portions of, and preventing cutting of hair by the bladeset and including two continuous, spaced, blocked portions defining a relatively narrow cutting area between the continuous, spaced, blocked portions, said cutting area having a width generally corresponding to the height of a subject's eyebrow;

at least one deflecting formation associated with said guard formation for deflecting hair clippings generated by action of the bladeset in said cutting area;

at least one guide formation projecting from said cutting area and configured for guiding hair into said cutting area;

said at least one deflecting formation includes at least one planar fan rib projecting generally forwardly said at least one guide formation from, and adjacent at least one side of said cutting area, each said at least one fan rib projecting forwardly from said at least one guard formation in a plane parallel to a cutting line defined by the bladeset and generally inclined relative to a plane of reciprocation defined by the bladeset on either side of said cutting area, and at least one deflecting surface including a panel spaced above the bladeset and configured for deflecting clippings away from said cutting area;

said at least one fan rib projecting from the line in a first direction, and said at least deflecting surface protecting from the line in a second direction distinct from said first direction; and said at least one deflecting surface is inclined relative to the bladeset, said at least one fan rib and said at least one deflecting surface are inclined at approximately the same angle relative to the bladeset.

16. The attachment and hair clipper of claim 15 wherein said at least one guide formation is a plurality of spaced comb teeth.

17. The attachment and hair clipper of claim 15 wherein said at least one deflecting surface includes an edge tapering from said cutting area toward ends of the bladeset.

18. An eyebrow comb attachment in combination with to a hair clipper having a bladeset with a moving blade laterally reciprocating relative to a stationary blade and defining a cutting line, comprising:

a guard formation having two continuous, spaced portions configured for blocking access of hair to an associated pair of blocked portions of the bladeset, for preventing hair cutting by the blocked portions and defining a relatively narrow cutting area between the continuous, spaced, blocked portions; and each said spaced portion including a deflecting formation associated with said guard formation for deflecting hair clippings generated by action of the bladeset in said cutting area, said deflecting formation including a generally planar fan rib projecting forward from the cutting line in a plane generally parallel to the cutting line, and a deflecting surface projecting rearward from the cutting line and in a direction generally opposite said fan rib; and at least one guide formation associated with said cutting area and configured for guiding hair into said cutting area for clipping;

said at least one fan rib curves in an arc from a side of a corresponding one of said at least one guide formation to one of said spaced portions blocking access of hair to the bladeset.

* * * * *